US007744400B2

(12) United States Patent
Carmitchel

(10) Patent No.: US 7,744,400 B2
(45) Date of Patent: Jun. 29, 2010

(54) ELECTRICAL CORD LOCKING CONNECTOR

(75) Inventor: Richard A. Carmitchel, Bonner Springs, KS (US)

(73) Assignee: R C Design & Engineering Incorporated, Bonner Springs, KS (US)

( * ) Notice: Subject to any disclaimer, the term of this patent is extended or adjusted under 35 U.S.C. 154(b) by 39 days.

(21) Appl. No.: 12/156,244

(22) Filed: May 30, 2008

(65) Prior Publication Data

US 2009/0209127 A1 Aug. 20, 2009

Related U.S. Application Data

(63) Continuation-in-part of application No. 12/070,020, filed on Feb. 14, 2008.

(51) Int. Cl.
*H01R 13/62* (2006.01)

(52) U.S. Cl. ..... 439/369

(58) Field of Classification Search ..... 439/369, 439/371, 372, 373, 364, 346
See application file for complete search history.

(56) References Cited

U.S. PATENT DOCUMENTS

| | | | | |
|---|---|---|---|---|
| 4,514,026 | A | 4/1985 | Herbert | |
| 4,596,430 | A | 6/1986 | Olson | |
| 4,875,874 | A | 10/1989 | Windsor | |
| 4,917,627 | A * | 4/1990 | Hendricks | 439/371 |
| 4,957,450 | A | 9/1990 | Pioszak | |
| 5,316,493 | A | 5/1994 | Sowers | |
| 5,454,729 | A | 10/1995 | Wen-Te | |
| 5,584,720 | A | 12/1996 | Elswick | |
| 5,893,772 | A | 4/1999 | Carmo et al. | |
| 6,093,045 | A | 7/2000 | Hoff | |
| 6,863,555 | B2 * | 3/2005 | Ito | 439/353 |
| 7,108,538 | B2 | 9/2006 | Ratzlaff et al. | |
| 7,287,994 | B1 | 10/2007 | Liao | |
| 7,452,233 | B1 * | 11/2008 | Michelsen | 439/369 |

OTHER PUBLICATIONS

Voltec Industries E-Zeelock.

* cited by examiner

*Primary Examiner*—Alexander Gilman
(74) *Attorney, Agent, or Firm*—Chase Law Firm, L.C.

(57) ABSTRACT

An electrical cord locking connector joins electrical cords in series and presents a streamlined profile that minimizes interference in restricted spaces through which the cords must be fed to service a job site. The connector joins the ends of successive cords utilizing the outwardly projecting shoulder provided on the female socket of one cord in cooperation with a latch member on the male end of the connecting cord to lock the two cords together. A cord provided with a female end terminating in a replacement cord cap is provided with a socket presenting a generally circular face and an outwardly projecting shoulder at the face for engaging a releasable latch member of a mating plug, thereby preventing separation of the plug and socket under force until the latch member is disengaged.

19 Claims, 3 Drawing Sheets

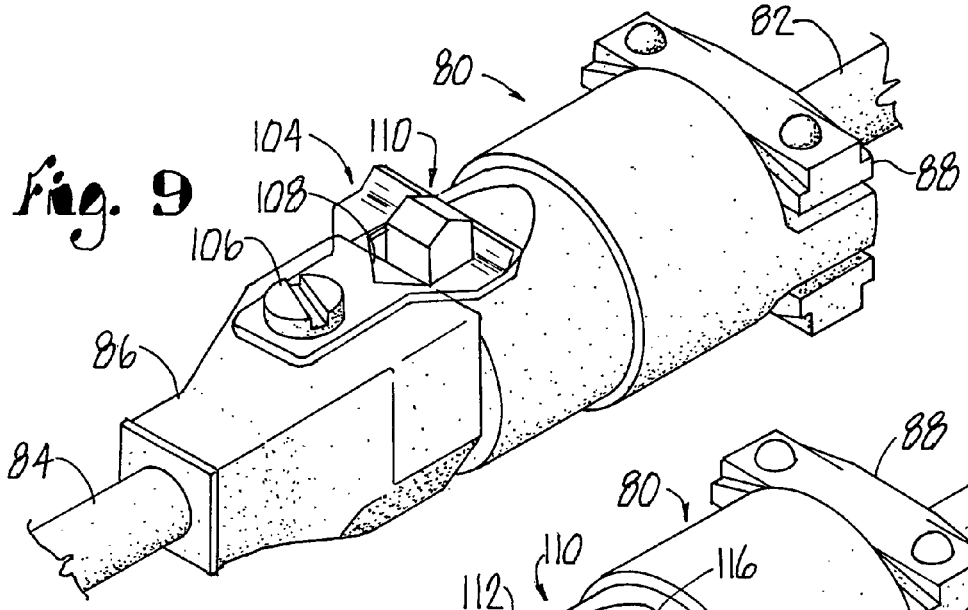
Fig. 9
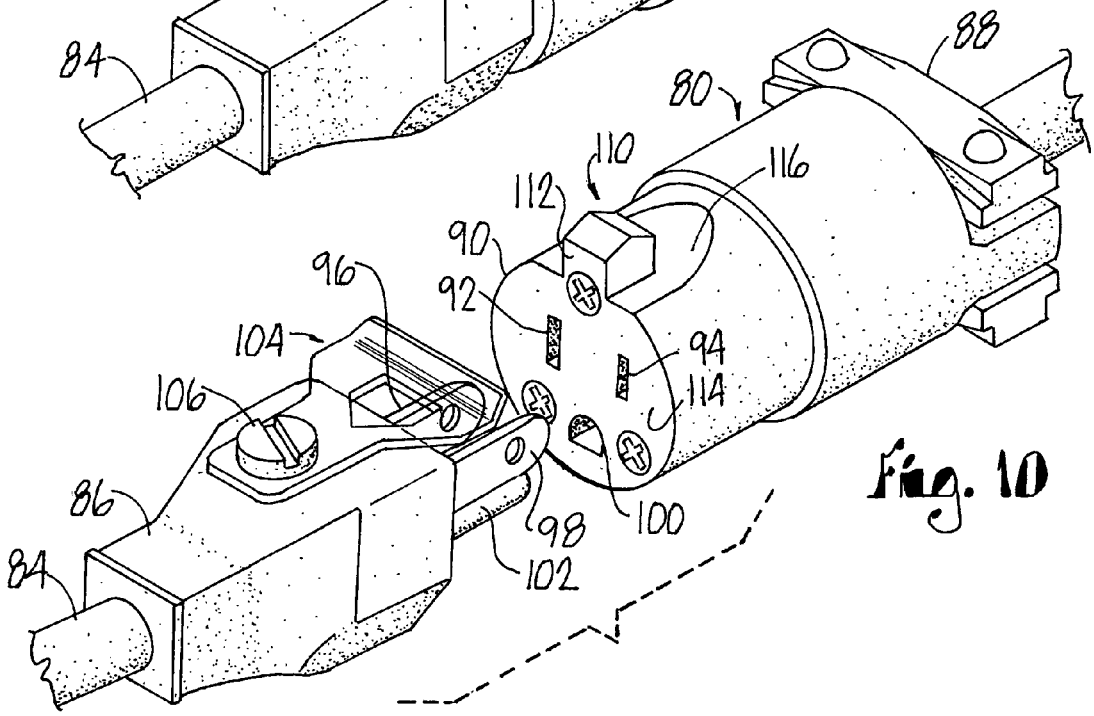
Fig. 10
Fig. 11
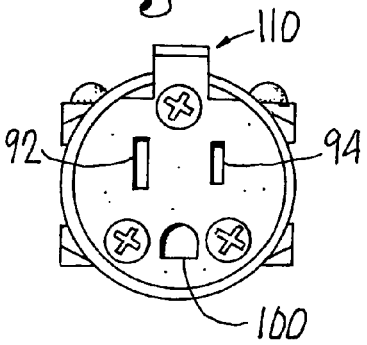
Fig. 12
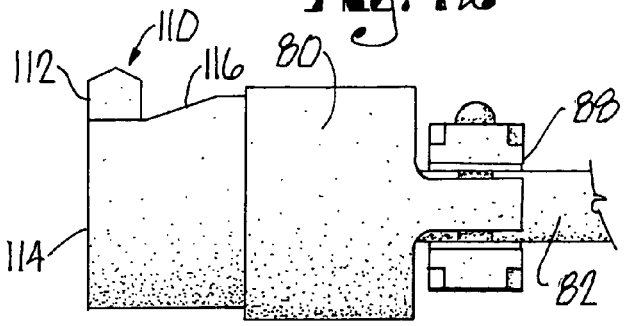

ELECTRICAL CORD LOCKING CONNECTOR

This application is a continuation-in-part of application Ser. No. 12/070,020, filed Feb. 14, 2008.

FIELD OF THE INVENTION

This invention relates to locking connectors for electrical extension and power cords to prevent separation of series-connected cords during use.

BACKGROUND OF THE INVENTION

In the construction of buildings and other structures a live electrical outlet is often remote from the area where workmen require electric power to operate power tools of various types. A typical example is a carpenter utilizing a power tool in a multi-floor structure or single floor areas having a long horizontal expanse. In these common construction environments electrical power tools are supplied with electricity using long extension cords connected in series, which may span long horizontal distances as well as vertically through several floors. When power cords separate under stress, time is lost and the broken connection may be difficult to locate and reestablish.

Also, in a construction environment, a series of extension cords are often threaded through openings, around corners and, under stress, separate at the weakest point which is usually where they are joined end to end. Separation at the union of two cords or at the power cord of a tool is not uncommon, thereby causing a complete shut down of electrically-powered equipment. Although locking devices have been proposed and used at the interconnection between two cords to assist in preventing separation, such devices may project radially and thus increase the transverse dimension of the cords at the connection, thereby presenting an obstacle to passing the connected cords through an opening or around a corner. When this occurs, the cords cannot be advanced until fed by hand through or around the turn or other obstacle, also resulting in lost time.

Furthermore, safety regulations in construction environments may require that a locking connector be used at the joinder of electrical cords in series in order to preclude separation under longitudinal stress and possible exposure of workers to electric shock. This could be caused, for example, by an uncoupled end of an extension cord being exposed to moisture at a construction site. This further evidences the need for an improved locking connector that provides a minimum of interference with handling and movement of serially connected electrical cords in a construction environment.

SUMMARY OF THE INVENTION

In an embodiment of the present invention an electrical cord locking connector presents a streamlined profile and does not project radially outwardly at the junction of two interconnected cords, thereby minimizing interference in tight spaces through which the extension cords must be fed to service the job site. The connector joins the ends of the successive cords utilizing the outwardly projecting shoulder provided on the socket end of one cord, the socket cooperating with a latch member on the male end of a connecting cord to lock the two cords together at the mating ends without utilizing laterally projecting components that would prevent the normal feeding of the interconnected cables around corners and through openings and other restricted spaces.

In another aspect of the invention, a first electrical cord has an end provided with a plug having at least three prongs, one of which is connected to the grounding conductor of the cord, and a second cord has an end provided with a socket having at least three openings therein for receiving corresponding prongs of the first cord. The socket has an outwardly projecting shoulder for preventing improper mating of the prongs and openings, and the plug has a releasable latch member projecting therefrom which engages the shoulder when the plug and socket are properly mated to prevent separation of the plug and socket during use of the cords.

In another aspect of the present invention, the latch member comprises a plate element having an opening therein for receiving the shoulder on the female socket when the plug and socket are mated and, in a further aspect of the invention, the plate element flexes as the plug and socket are mated to clear the shoulder until the opening in the plate element registers therewith.

In another aspect of the present invention a latch member is flexed as the cords are connected and shifts to a locking position receiving the shoulder when the opening in the plate registers therewith. Furthermore, in an alternative arrangement the latch member is provided with a lip for engaging the shoulder when the plug and socket are mated.

In yet another aspect of the present invention a replacement cord cap assembly is provided with a radially outwardly projecting shoulder at the face of the socket adjacent the two openings in the socket that receive corresponding current-carrying prongs of a male plug. The shoulder is received by a latch member on a connecting cord to prevent separation of the plug and socket.

Other advantages of this invention will become apparent from the following description taken in connection with the accompanying drawings, wherein is set forth by way of illustration and example, embodiments of the present invention.

BRIEF DESCRIPTION OF THE DRAWINGS

FIG. 9 is a perspective view of a third embodiment of the present invention showing the mating ends of two extension cords connected together and locked, the female end being provided with a replacement cord cap.

FIG. 10 is a view similar to FIG. 9 but exploded to reveal the parts prior to inserting the plug into the socket to connect the two extension cords together.

FIG. 11 is a front view of the replacement cord cap showing the face of the socket.

FIG. 12 is a side elevational view of the female replacement cord cap.

DETAILED DESCRIPTION

Figure 1:
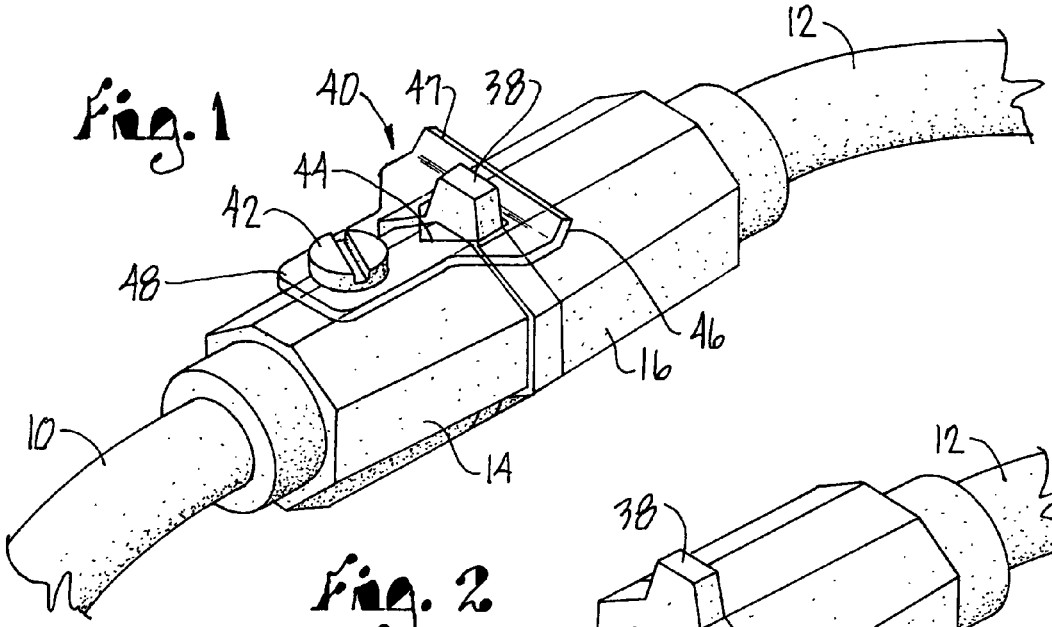
FIG. 1 is a perspective view of one embodiment of the present invention showing the mating ends of two extension cords connected together and locked.
Figure 2:
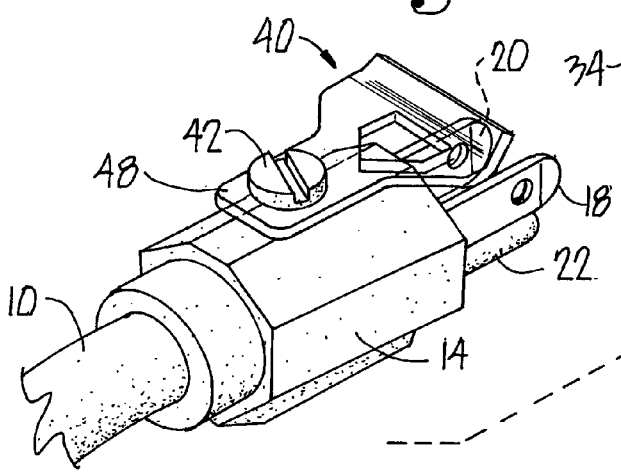
FIG. 2 is a view similar to FIG. 1 but exploded to reveal the parts prior to the inserting the plug into the socket to connect the two extension cords together.
Figure 2:
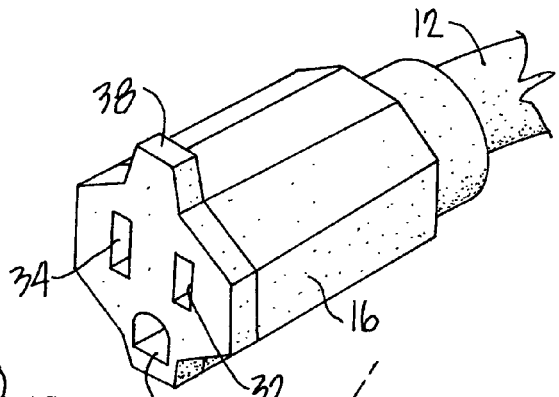

Referring initially to FIGS. 1 and 2, the mating ends of two extension cords 10 and 12 are shown connected together in FIG. 1 and separated in FIG. 2 in alignment with each other to show the male and female parts aligned prior to connecting cords 10 and 12 together. The end of cord 10 illustrated is provided with a male plug 14 which, in FIG. 2, is shown aligned with but withdrawn from a female socket 16 on the corresponding end of cord 12. It should be appreciated that cords 10 and 12 may extend 50 feet or more from the mating plug and socket illustrated in FIGS. 1 and 2 where the remote end of cord 10 would be provided with a socket, and the remote end of cord 12 would be provided with a plug. Accordingly, at a construction site where extension cords are used to connect power tools to a current source, series connected cords may extend hundreds of feet.

Figure 3:
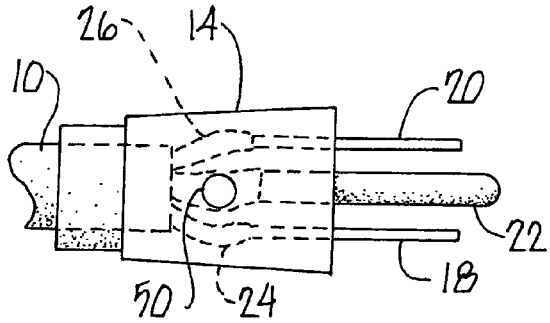
FIG. 3 is a plan view of the male plug with the latch plate removed.
Figure 4:
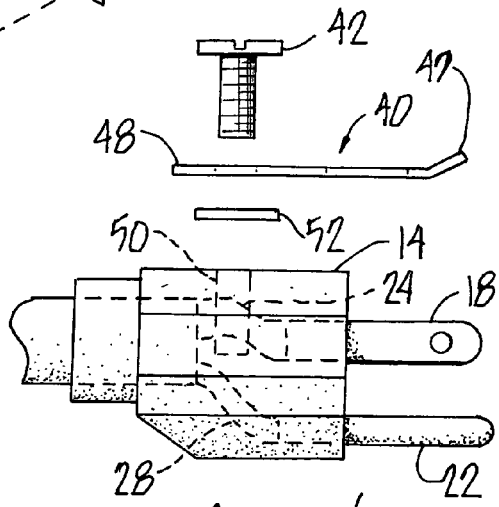
FIG. 4 is an exploded, side elevational view of the plug and latch parts.

Referring also to FIGS. 3 and 4, plug 14 is typically provided with three prongs 18, 20 and 22. Extension cords for a two-wire, grounded source, such as a 110 volts AC, are illustrated herein, but it will be appreciated that the teachings of the present invention are equally applicable to other applications where a series of extension cords are required to reach a site remote from the power source. As shown in FIGS. 3 and 4, a hot wire 24 is connected to prong 18, a grounded wire 26 is connected to prong 20, and a grounding wire 28 is connected to prong 22 in the conventional manner. The prongs 18, 20 and 22 are received by the socket 16 at openings 32, 34 and 36 respectively in the conventional manner.

In order to prevent inadvertent improper mating of the plug 14 and socket 16 such that the grounding prong 22 would not be received in opening 36, the socket 16 is typically provided with a shoulder 38 which would prevent such a misconnection because it would be engaged by the grounding prong 22 and thus the prongs 18 and 20 could not be inserted. In the present invention, a latch plate 40 of a resilient plastic material is secured to the body of plug 14 by a non-metallic, self-threading screw 42 and has an opening 44 therein which receives shoulder 38 when plug 14 and socket 16 are united as shown in FIG. 1. The latch plate 40 is of a generally T-shaped configuration presenting a head 46 terminating in an upwardly curved lip 47, and an integral stem 48 through which the screw 42 extends to secure the latch plate 40 to the body of the plug 14. As the plug 14 is mated with the socket 16, the shoulder 38 engages head 46 and flexes the plate 40 upwardly as viewed in FIGS. 1 and 2 until it registers with the opening 44 and is received therein as shown in FIG. 1 in its final position. The lip 47 assists the user in manually flexing the head 46 upwardly until it clears the shoulder 38. Accordingly, force applied to the cords 10 and 12 in normal use that could cause the plug 14 and socket 16 to separate are resisted in the present invention by the interengagement of the latch plate 40 and shoulder 38, which prevents separation of plug 14 from socket 16. Therefore, the present invention locks the two cords 10 and 12 together to prevent separation under stress conditions. It should be understood, however, that the latch plate 40 does not affect use of the plug in a normal wall socket as the latch plate can be rotated 180 degrees to a non-interfering position.

Utilization of the self-tapping screw 42 facilitates adding the locking feature of the present invention to existing extension cords. Referring to FIGS. 3 and 4, a hole 50 bored in plug 14 receives screw 42 which extends through a hole (not visible) in stem 48 and tightly secures the latch plate 40 to the plug 14. Note in FIG. 4 that hole 50 is between hot wire 24 and grounded wire 26 and does not reach grounding wire 28. As seen in the exploded view of FIG. 4, a washer 52 receiving screw 42 may be disposed between the stem 48 and the underlying surface of plug 14.

It should also be noted that the latch plate 40 prevents a two-prong male plug from being inserted improperly into a socket. If this is attempted, the plate 40 engages the socket at the projection that presents the grounding opening 36.

Figure 5:
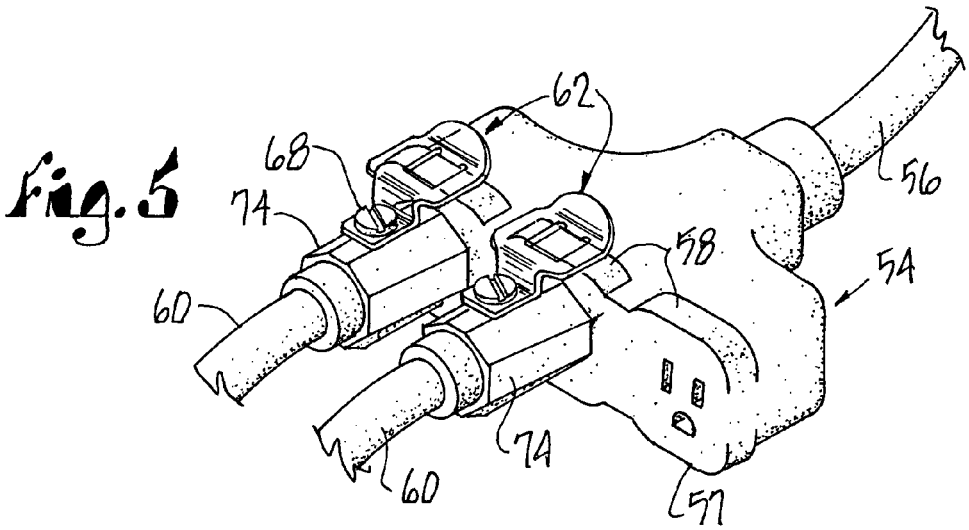
FIG. 5 is a perspective view of a second embodiment of the present invention showing electrical cords connected to a multiple outlet socket assembly wherein each shoulder is continuous over the top of the respective socket face.
Figure 6:
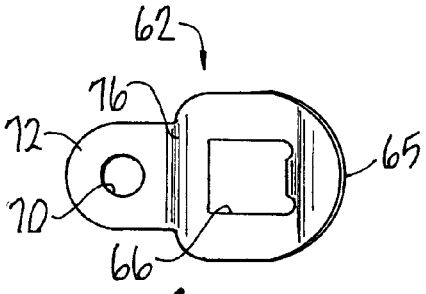
FIG. 6 is a detail, plan view of a latch plate having a depending lip.
Figure 7:
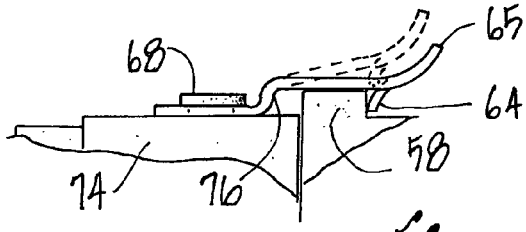
FIG. 7 is a side elevational, detail view showing the depending lip of the latch plate of FIG. 6 engaging a shoulder.
Figure 8:
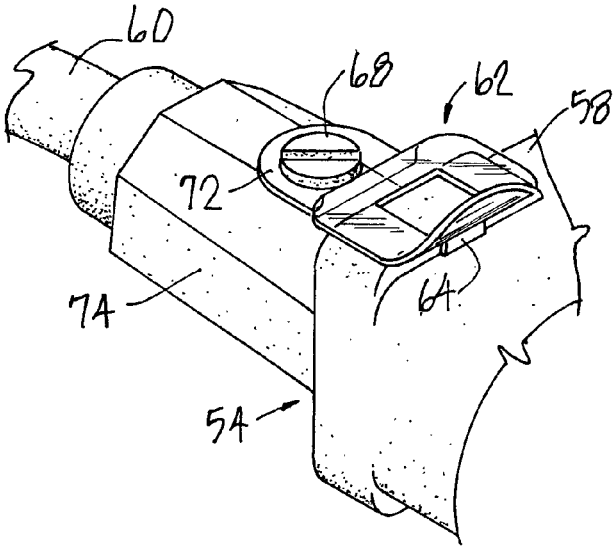
FIG. 8 is a partial, enlarged perspective view of the second embodiment showing the latch plate of FIG. 6 in its locked position.

Referring to FIGS. 5-8, the present invention may also be utilized with extension cords having multiple socket faces, as illustrated in FIG. 5 where a triple socket 54 on one end of a cord 56 is illustrated. It should be noted that each socket face 57 presents a longer upper shoulder 58 than in the single ended extension cords 10 and 12 shown in FIGS. 1 and 2. To lock an extension cord 60 to a corresponding shoulder 58, a latch plate 62 having a depending lip 64 is utilized as best seen in FIGS. 6-8. More particularly, latch plate 62 has a central opening 66 therein from which lip 64 depends at the forward end thereof, as can be seen by a comparison of FIGS. 6 and 7. A screw 68 extends through an opening 70 in a stem portion 72 of the latch plate 62 in a manner similar to the embodiment of FIGS. 1-4. Screw 68 secures latch plate 62 to a plug 74 and is shown fully installed and locked in FIGS. 7 and 8.

It should be noted that the latch plate 62 has an offset 76 that permits the latch to overlie the raised shoulder 58 and cause the downwardly projecting lip 64 to engage the backside of shoulder 58 and thus lock plug 74 to the socket unit 54. As the plug 74 is inserted, the curved end 65 facilitates swinging the latch plate 62 to the broken line position (FIG. 7) until the plug 74 is fully inserted, whereupon the plate 62 shifts to the full line position shown where lip 64 engages the backside of the shoulder 58. As latch plate 62 is composed of a resilient plastic, it snaps into place in the full line position shown in FIG. 7 to prevent withdrawal of the plug 74.

Another embodiment of the present invention is shown in FIGS. 9-12 and may be utilized to join two end-to-end cords, one or both of which is severed or otherwise defective and, for example, is provided with a replacement cord cap 80 on the end of a cord 82 connected to a cord 84 provided with a male plug 86 having a configuration similar to plugs 14 and 74 of the embodiments illustrated in FIGS. 1-8. As is conventional, the replacement cord cap 80 is provided with a clamp 88 which secures the cord cap 80 to the cord 82 and presents, at its outer end, a socket face 90 which, before modification in accordance with the present invention, is of circular configuration. Socket 90 has openings 92 and 94 therein receiving prongs 96 and 98 respectively of plug 86 connected to hot and grounded wires respectively in cable 84 in the conventional manner, and an opening 100 receiving prong 102 connected to the grounding wire.

The male plug 86 is provided with a latch plate 104 of the same configuration as latch plate 40 in FIGS. 1-4. The latch plate 104 is secured by a screw 106 to the plug 86 and has an opening 108 therein receiving a shoulder 110 on socket 80 having a front surface 112 coplanar with the face 114 of socket 90. To accommodate the shoulder 110, the socket 90 is recessed at 116 to properly position the shoulder 110 for engagement with the latch plate 104 as seen in FIG. 9 where the socket and plug components 80 and 86 are mated and locked. It should be understood that other latch plates of similar configuration may also be utilized, such as the latch plate 62 illustrated in FIGS. 5-7 without the offset 76.

It should be appreciated that the embodiment of the invention shown in FIGS. 9-12 provides the ability to lock two cords together when the female mating end has been damaged and fitted with a replacement cord cap. This is accomplished as set forth above by modification of the cap by the addition of the shoulder 110 in recess 116 to accommodate the latch plate 104 on the male end of the connecting cord.

It should be understood that while certain forms of this invention have been illustrated and described, it is not limited thereto except insofar as such limitations are included in the following claims.

Having thus described the invention, what is claimed as new and desired to be secured by Letters Patent is:

1. An electrical cord locking connector comprising:

first and second electrical cords, each having a pair of current-carrying conductors and a grounding conductor, said first cord having an end provided with a plug having a pair of prongs connected to respective current-carrying conductors, and a third prong connected to the grounding conductor thereof, said second cord having an end provided with a socket presenting a face having at least three openings therein for receiving corresponding prongs of said first cord, said socket having an outwardly projecting shoulder adjacent said face engageable by said third prong for preventing improper mating of said prongs and openings if the prongs and openings are improperly aligned, and said plug having a releasable latch member projecting therefrom and engaging said shoulder when the plug and socket are properly mated to prevent separation of the plug and socket during use of the cords.

2. The connector as claimed in claim 1, wherein said latch member comprises a plate element having an opening therein for receiving said shoulder when the plug and socket are mated.

3. The connector as claimed in claim 2, wherein said plate element is composed of a resilient material permitting the element to flex as the plug and socket are mated to clear said shoulder until the opening registers therewith.

4. The connector as claimed in claim 2, wherein said plate element is elongated and flexible and has inner and outer end portions, said outer end portion having said opening therein, said inner end portion being secured to said plug, whereby the plate element is flexed as the cords are connected and shifts to a locking position receiving the shoulder when the opening registers with the shoulder.

5. The connector as claimed in claim 2, wherein said plate element has a generally T-shaped configuration and presents a head having said opening therein for receiving said shoulder, and a stem portion secured to said plug.

6. The connector as claimed in claim 5, further comprising a self-tapping screw securing said stem portion to said plug.

7. The connector as claimed in claim 1, wherein said latch member has a lip for engaging said shoulder when the plug and the socket are mated.

8. The connector as claimed in claim 1, wherein said socket has a generally circular face presenting said openings, said shoulder projecting outwardly from said face between two of said openings connected to respective current-carrying conductors and from a side of said socket opposite said grounding conductor.

9. An electrical connector comprising:

first and second electrical connecting devices, each having at least a pair of current-carrying conductors, said first device having an end provided with a plug having at least two prongs, said second device having an end provided with a socket having at least two openings therein for receiving corresponding prongs of said first device, said socket having a laterally outwardly projecting shoulder coextensive with said face for preventing improper mating of said prongs and openings, and said plug having a releasable latch member projecting therefrom and engaging said shoulder when the plug and socket are mated to prevent separation of the plug and socket during use.

10. The connector as claimed in claim 9, wherein said latch member comprises a plate element having an opening therein for receiving said shoulder when the plug and socket are mated.

11. The connector as claimed in claim 10, wherein said plate element is composed of a resilient material permitting the element to flex as the plug and socket are mated to clear said shoulder until the opening registers therewith.

12. The connector as claimed in claim 10, wherein said plate element is elongated and flexible and has inner and outer end portions, said outer end portion having said opening therein, said inner end portion being secured to said plug, whereby the plate element is flexed as the devices are connected and shifts to a locking position receiving the shoulder when the opening registers with the shoulder.

13. The connector as claimed in claim 10, wherein said plate element has a generally T-shaped configuration and presents a head having said opening therein for receiving said shoulder, and a stem portion secured to said plug.

14. The connector as claimed in claim 13, further comprising a self-tapping screw securing said stem portion to said plug.

15. The connector as claimed in claim 9, wherein said latch member has a lip for engaging said shoulder when the plug and the socket are mated.

16. A replacement cord cap assembly comprising:

first and second electrical connecting devices, each having at least a pair of current-carrying conductive elements and a grounding conductor, said first device having an end presenting a plug having first and second prongs connected with respective current-carrying elements thereof, and a third prong connected with said grounding conductor thereof, said second device having an end provided with a socket presenting a generally circular face and having at least three openings therein for receiving corresponding prongs of said first device, a pair of said openings being presented by respective current-carrying elements of said second device, said socket having a laterally outwardly projecting shoulder coextensive with said face adjacent said pair of openings, and said plug having a releasable latch member projecting therefrom and engaging said shoulder when the plug and socket are mated, thereby preventing separation of the plug and socket under force until the latch member is disengaged.

17. The replacement cord cap assembly as claimed in claim 16, wherein said latch member comprises a plate element having an opening therein for receiving said shoulder when the plug and socket are mated.

18. The replacement cord cap assembly as claimed in claim 17, wherein said plate element is composed of a resilient material permitting the element to flex as the plug and socket are mated to clear said shoulder until the opening registers therewith.

19. An electrical cord locking connector comprising:

first and second electrical cords, each having a pair of current-carrying conductors and a grounding conductor, said first cord having an end provided with a plug having at least three prongs, one of which is connected to the grounding conductor thereof, said second cord having an end provided with a socket having at least three openings therein for receiving corresponding prongs of said first cord, said socket having a generally circular face presenting said openings, and an outwardly projecting shoulder for preventing improper mating of said prongs and said openings, said plug having a releasable latch member projecting therefrom and engaging said shoulder when the plug and socket are properly mated to prevent separation of the plug and socket during use of the cords, and said shoulder projecting outwardly from said face between two of said openings connected to respective current-carrying conductors and from a side of said socket opposite said grounding connector.

* * * * *